United States Patent [19]

Elkins

[11] Patent Number: 4,648,516

[45] Date of Patent: Mar. 10, 1987

[54] ADJUSTABLE GUN RACK

[76] Inventor: Johnny C. Elkins, P.O. Box 2599, San Angelo, Tex. 76902

[21] Appl. No.: 691,403

[22] Filed: Jan. 14, 1985

[51] Int. Cl.[4] ..... A47F 7/00

[52] U.S. Cl. ..... 211/64; 224/42.45 R; 248/354.6

[58] Field of Search ..... 211/64, 94, 94.5, 87, 211/103, 208; 224/42.45 R, 913; 248/354.5, 354.6

[56] References Cited

U.S. PATENT DOCUMENTS

| | | | |
|---|---|---|---|
| 621,856 | 3/1899 | Schwarz | 211/208 X |
| 2,536,293 | 1/1951 | Koses | 211/87 X |
| 3,731,817 | 5/1973 | Fowlkes et al. | 211/94.5 X |
| 3,836,174 | 9/1974 | Holman, Jr. | 248/354.5 X |
| 4,021,012 | 5/1977 | Miller | 248/354.6 X |
| 4,108,313 | 8/1978 | Bogar, Jr. | 211/64 |
| 4,450,989 | 5/1984 | Bogar, Jr. | 211/64 X |

*Primary Examiner*—Ramon S. Britts
*Assistant Examiner*—Blair M. Johnson
*Attorney, Agent, or Firm*—Marcus L. Bates

[57] ABSTRACT

A gun mount comprises two spaced adjustable gun racks, each gun rack has a square tubular main body to which there is adjustably attached one or a plurality of upwardly opening cradles within which a gun can be supported. Each main body includes opposed attachment means by which it is removably supported from the gasket which holds the rear window glass within a vehicle. One of the attachment means has a marginal end telescopingly received within the main body, and a blade is formed at the other end thereof. The other end of the main body is provided with an opposed blade. Each of the blades are received between the glass and the gasket of a vehicle window, and the outer end portion of the blade is turned laterally so that the lateral portion of the blade engages an edge portion of the window glass and thereby captures the rack to the window. The gun rack can be used in conjunction with a vehicle window, or alternatively, can be mounted directly to any wall surface.

15 Claims, 8 Drawing Figures

ADJUSTABLE GUN RACK

BACKGROUND OF THE INVENTION

In my previous U.S. Pat. Nos. 3,876,079, 3,931,893; 4,058,221; and Des. 238,228, there is disclosed a gun mount for the rear window of a vehicle. The gun mount includes spaced rack members, each of which is made into two coacting pieces so that the opposed attachment blades thereof can be extended respective to one another to thereby provide for a range of adjustment therebetween. However, the range of adjustment is relatively small, and it is often inconvenient to place more than two cradles on each of the main body members of the racks.

It would be desirable to have made available a gun rack which can be used for the rear window of a vehicle, such as a pickup truck, for example, as well as being used as a decorative rack mounted directly to any wall surface, for example, the wall surface of a home or hunting lodge. It would also be desirable to have made available a gun rack having a main body which is supported at each end thereof by attachment means wherein the attachment means can be moved respective to one another to provide a relatively great range of adjustment therebetween.

Furthermore, it would be desirable to have made available a gun rack which can accommodate more than two gun supporting cradles in the event that space considerations admit the length between the attachment means to be extended sufficiently to accommodate the extra cradles.

It would further be desirable to have made available a gun rack having gun receiving cradles which can be adjustably moved along the length of the main body.

The present invention provides an improved adjustable gun rack having the above described desirable features, and which overcomes the above drawbacks of the prior art.

THE PRIOR ART

The most pertinent of the prior art of which Applicant is aware is the above recited patents, the art cited therein, and the prior art listed hereinafter.

None of the above prior art discloses nor describes a gun rack having a main body for supporting a plurality of gun receiving cradles, wherein each of the cradles can be individually adjusted respective to the main body, and wherein the main body is a square tubular member which telescopingly receives in a slidable manner an adjustable attachment means at each end thereof. Further, the details of the adjustable cradle set forth in the present invention is not found in the above prior art.

SUMMARY OF THE INVENTION

A gun rack comprised of a square tubular main body having a fixed attachment means at the lower end thereof, and an adjustable attachment means at the upper end thereof. The main body can be made any convenient length, and adjustably receives a plurality of upwardly opening gun receiving cradles respective thereto.

The upper attachment means has a lower marginal end adjustably received in a slidable manner within the main body. The upper end of the upper attachment means terminates in a flat blade. The flat blade can be inserted in captured relationship between a window glass and the gasket therefor. Alternatively, the blades of each of the opposed attachment means can be directly attached to any suitable wall surface.

Each of the cradles are captured to the main body in a slidable manner, and further includes a latch means by which the individual cradles can be latched into a number of different predetermined positions.

The lower attachment means preferably is fixed respective to the main body. The main body can be easily shortened to provide large or small adjustments in length, and the telescoping action of the upper attachment means respective to the main body provides another adjustment means by which the spaced distance between the blades can be adjusted.

The design of the cradle and its cooperative action with the main body provides an unusually rugged gun rack construction. Two racks arranged in side by side spaced parallel relationship provides an improved mount means by which firearms can be safely transported in a vehicle, or alternatively, provides a decorative gun mount when attached to most any wall surface.

Accordingly, a primary object of the present invention is the provision of an improved mount for supporting one or a plurality of firearms.

Another object of the present invention is the provision of an improved rack having opposed attachment means, one of which is adjustably received respective to a main body thereof.

A further object of the present invention is the provision of an improved mount comprising a pair of spaced similar racks, each rack having one or a plurality of gun receiving cradles which are slidably received respective to the main body of the rack so that the spaced distance between adjacent cradles of a rack can be easily adjusted.

A still further object of this invention is the provision of a gun mount having a pair of racks, wherein each rack has opposed supports thereon which cooperate with a main body thereof in such a manner that the supports can be adjustably moved towards and away from one another.

Another and still further object of this invention is the provision of a gun mount having a pair of racks, with gun receiving cradles being captured in a slidable manner respective to a main body thereof which enables the cradles to be adjustably positioned along the main body.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
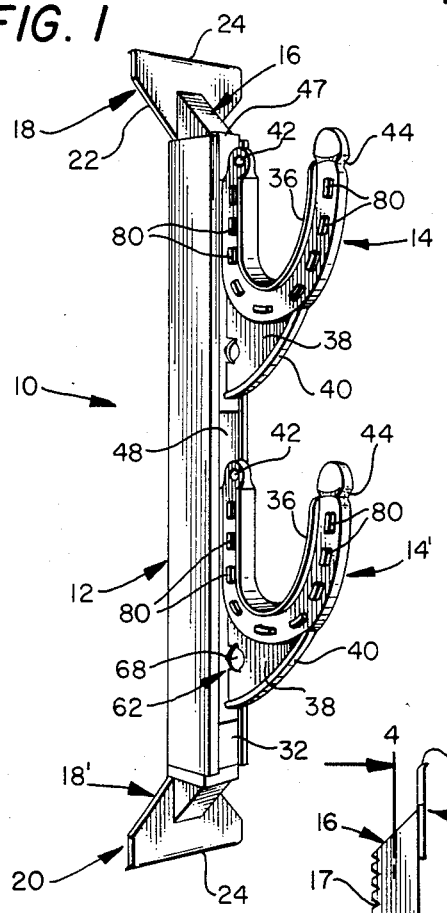
FIG. 1 is a perspective view of a gun rack made in accordance with the present invention.
Figure 3:
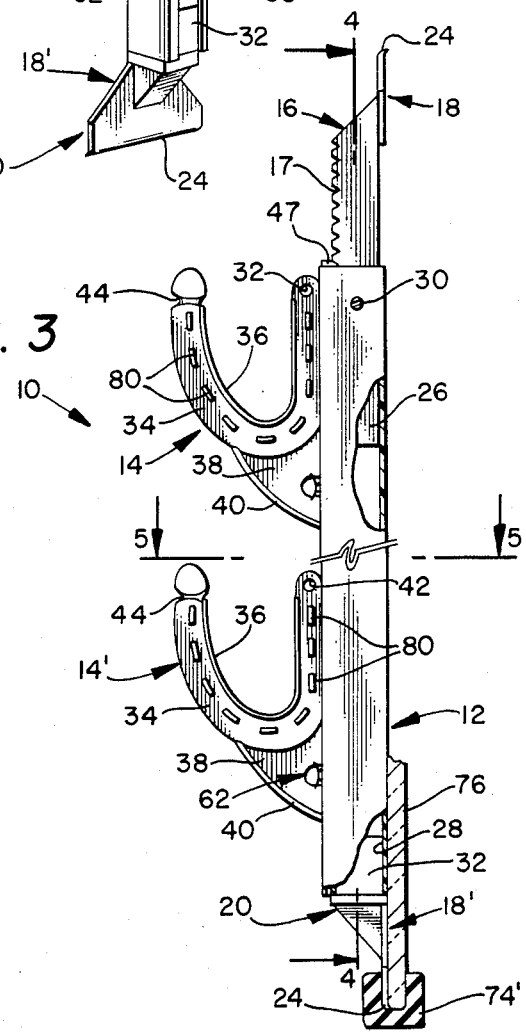
FIG. 3 is an enlarged, side elevational view of the rack disclosed in FIGS. 1 and 2, with some parts being broken away therefrom, and some of the remaining parts being shown in cross-section.
Figure 4:
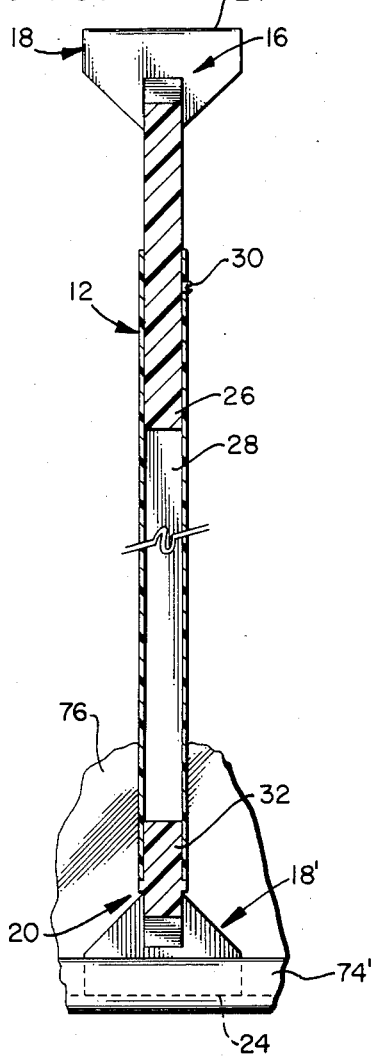
FIG. 4 is a cross-sectional view taken along line 4—4 of FIG. 3.

In the figures of the drawings, and in particular FIGS. 1 and 3, there is disclosed a rack device 10 made in accordance with the present invention. The rack device 10 includes a square main body having an axial passageway formed therethrough and to which there is attached a plurality of upwardly opening gun receiving cradles 14 and 14'. The upper marginal end of the main body telescopingly receives an adjustable extension 16. The adjustable extension includes teeth 17 which form a ratchet when engaged by member 47. The extension 16 terminates in a blade 18, the details of which are more fully described in my previous U.S. Pat. No. 4,402,164. The blade and extension form an attachment means by which the upper end of the rack is secured to a suitable surface, as will be more fully explained later on herein.

The lower end of the rack device is in the form of a fixed attachment means 20, and includes an opposed blade 18', substantially identical to the blade 18. In FIG. 3, the numeral 22 indicates the flat glass engaging surface of the blades 18 and 18'. The blades each terminate in a lateral gripper 24.

Figure 2:
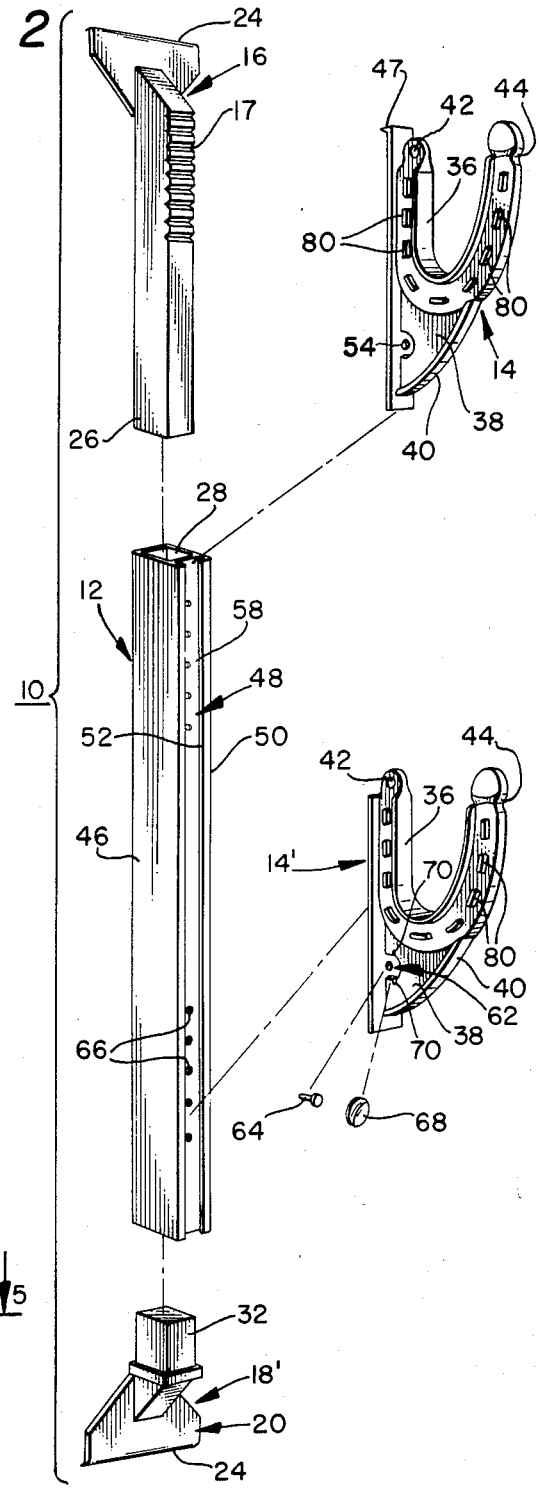
FIG. 2 is an exploded, perspective view of the gun rack disclosed in FIG. 1.

In FIG. 2, the numeral 26 broadly indicates the square inner marginal end of the extension 16. Numeral 28 indicates the interior of main body 12. A set screw 30 is optionally provided and extends through the main body and into engagement with the extension 16. The fixed support 20 has a marginal end portion 32 which is square in configuration, and which preferably is cemented into the illustrated position of FIG. 3.

Each of the cradles 14 and 14', which can number one or a plurality of cradles, includes an upwardly curved outer length 34, which preferably is made to simulate a horseshoe having horseshoe nails thereon. The inner peripheral surface of the cradle is provided with a gun engaging flange 36. A web 38 transfers the load from the curved part 34 of the cradle back into a vertical slide member 54, the details of which will hereinafter be more fully disclosed in conjunction with FIG. 5. A flange 40 is perpendicularly arranged respective to the web 38 and interconnects the curved part 34 of the cradle with the slide member 54. The near end of the curved cradle member is apertured at 42, while the far end of the curved member is provided with a notch 44. Leather, or a resilient length of similar material, can be looped through the aperture 42 and brought down into the notch 44 in order to secure a firearm within the cradle and thereby increase safety.

Figure 5:
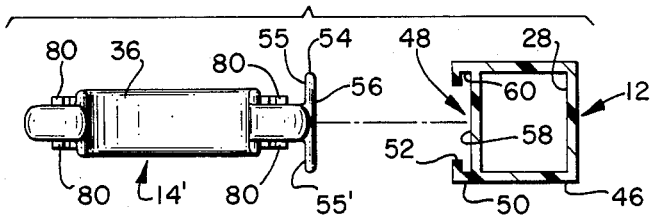
FIG. 5 is a cross-sectional view taken along line 5—5 of FIG. 4, with some of the parts being displaced from some of the remaining parts.

As best seen illustrated in FIG. 5, together with other figures of the drawings, the main tubular body 12 has an opened slot 48 formed along one longitudinally extending side thereof. The slot is formed by the illustrated opposed extended sidewalls 50 which are inwardly turned at 52 to provide the outwardly opening part thereof. A tongue 56 is formed by the before mentioned elongated slide member 54. The slide member 54 has opposed marginal sidewalls 55 and 55' which are received within the opposed grooves of the slot. The inner face of the tongue 56 is slidably received against the outer face 58 of the open slot 48, with the opposed marginal ends 55 and 55' of the tongue being captured by the confronting edge portions 52 of the slot. Numeral 60 indicates one of the tongue receiving grooves formed by the slot.

Figure 6:
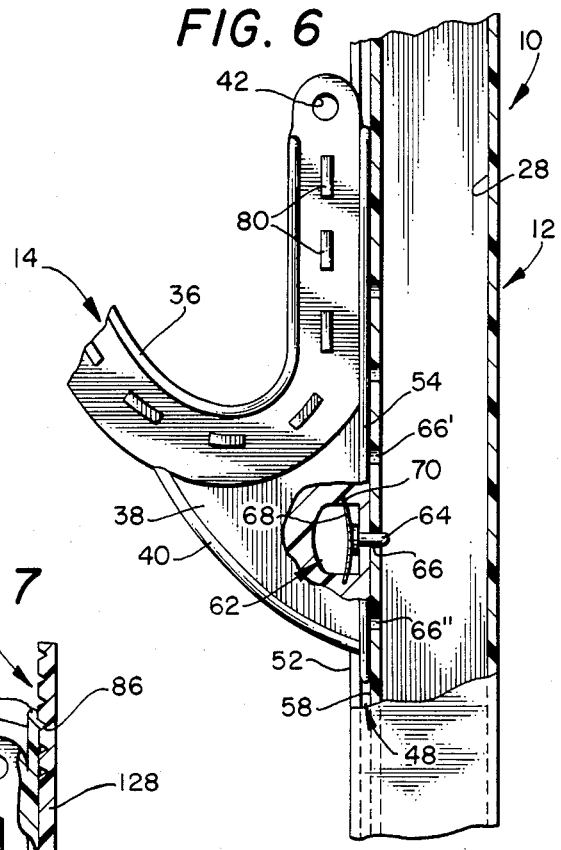
FIGS. 6 and 7 are enlarged, detailed views of parts of the apparatus disclosed in the foregoing figures; and, FIG. 8 is a diagrammatical, representation showing a gun mount, comprised of a pair of racks made in accordance with the present invention, with the racks being shown in attached relationship to the rear window of a vehicle.
Figure 7:
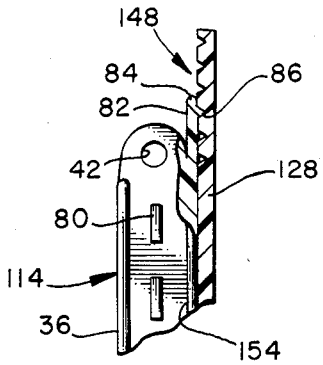

In FIG. 6, a port 62 is formed within web 38. Latch pin 64 extends through the slide 54 and through an aperture 66 formed through the face 58 of the slot 48. A spring 68, which can take on several different forms, is suitably captured within port 62 and by receiving the opposed edges of the spring within the illustrated notches 70 the spring is captured in the illustrated manner of FIG. 6 and thereby biases the pin 64 into the locked position.

Figure 8:
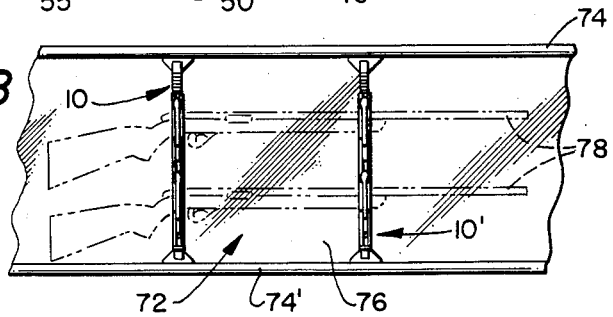

In FIG. 8, a vehicle rear window 72 is provided with a circumferentially extending gasket 74, 74' for holding window glass 76 within the vehicle structure in a manner known to those skilled in the art. A plurality of guns 78 are horizontally supported by the spaced cradles 10 and 10', respectively, located on the spaced racks, respectively, of the illustrated gun mount.

In operation, the main body 12 can be made of any desirable length, and if it is subsequently found that the length of the main body is too long to accommodate a projected use, it can be easily shortened by sawing a marginal end portion therefrom. The lower attachment means 20 preferably is fixed respective to the lower end of the main body, as for example, being cemented into the illustrated fixed position of FIG. 3. The extension 16 of the upper attachment means is telescopingly and slidably received within the upper marginal end of the hollow main body. The lower blade member 18' is forced between the gasket 74' and the window glass 76, with the lateral gripper 24 engaging the lower edge of the glass. The upper blade member 18 is similarly placed between the upper gasket 74 and glass 76, with the lateral gripper engaging the upper edge of the glass. Thereafter, screw 30 can be made up if desired.

One or more cradles 14, 14' are next mounted to the main frame in vertically spaced relationship as illustrated in FIG. 3. The tongue of the slide member 54 of each of the cradles is slidably received within the slot of the main body and is locked into position by the latch 64 being biased by spring 68 into the latched position, as seen illustrated in FIG. 6, wherein the latch pin 64 extends through aperture 66, thereby preventing relative movement between the cradle and the main body.

The cooperative action between the slide member 54 and the slot 48 captures the cradle to the main body with great force. The position of the cradle respective to the main body can be subsequently adjusted as may be desired by placing a screw driver under the head of the latch pin 64, urging the latch against spring 68 until the latch clears the aperture 66, whereupon the cradle assembly can then be slid vertically upward or downward, or completely removed from the main body. The slot 48 extends the entire length of the main body, so that the cradles can enter the slot from either of the opposed ends thereof.

The ratchet action of the teeth 17 and catch 47 releasably positions the extension 16 respective to the main body 12. The teeth 17 and catch 47 cooperate somewhat like the analogous parts found on a bumper jack. The catch 47 can be lifted from the teeth 17 in order to re-adjust the relative position of the upper attachment means respective to the main body.

The extension of the upper attachment means 16 with respect to the main body 12 is accomplished by sliding the upper attachment means 16 along with the cradle 14 upwardly until the ratchet member 47 extends clear of the upper end of the open slot 48 an amount that allows the ratchet member 47 to be resiliently disengaged respective to the teeth 17. At this position, the upper attachment means 16 can be moved respective to both the cradle and the main body by the ratchet action of the ratchet member 47 and ratchet teeth.

The gun rack device of the present invention can be attached to any window having a gasket and a glass combination wherein the glass is held within a frame by means of the gasket 74' in a manner similar to the gasket 74' of FIG. 3. The main body 12 can be made of a length which will conveniently accommodate three cradles, for example, and if it is subsequently found that the main body is too long, it can be sawed off an appropriate amount using common household tools, and only two cradles mounted into position, if insufficient space remains for accommodating all three of the cradles.

Moreover, it is possible to provide a very long main body which will accommodate any number of cradles. In this instance, the support blades 18 and 18' are directly attached to a suitable wall surface by screws or nails as may be deemed desirable.

The apparatus of the present invention preferably is fabricated by injection molding. The cradles 14 and 14' are preferably in the form of a horseshoe, and the firearms are captured within the cradles by looped leather thong tied through aperture 42 and looped about notch 44. The horseshoe configuration of the cradle imparts a western design into the apparatus. The exposed edges of the blades 18 and 18' can be provided with a bearing surface against which one's thumbs are placed in order to facilitate pushing each of the blades under the gasket, as well as more efficiently transferring the load from the blade into the main body.

I claim:

1. A gun rack for mounting guns in supported relationship therewithin; said rack includes a main body having a gun receiving cradle means, attachment means formed at each opposed end of said main body by which the rack can be affixed to a support surface;

said main body has a hollow interior at one end thereof, one said attachment means has an extension which is slidably received within the hollow interior of the main body, thereby enabling the spaced opposed attachment means to be moved towards and away from one another, and thereby adjust the distance therebetween;

said extension has one outer wall surface which is provided with teeth, means formed on said cradle means which engages the teeth of the outer wall surface and thereby adjustably secures the extension to the main body;

and means by which said cradle means can by adjustably positioned longitudinally along the main body and said extension.

2. The gun rack of claim 1 wherein said attachment means includes a blade having a marginal edge portion which is sufficiently thin in cross-section to be received between the gasket and glass associated with a window, whereby the marginal edge of the blade can be forced between the gasket and glass to hold the rack in mounted relationship therewith.

3. The gun rack of claim 1 wherein said main body has a longitudinally extending slot formed on one outer wall surface thereof, said cradle means has a tongue which is slidably received within said slot and thereby enables the cradle means to be slidably positioned along the length of said main body.

4. The gun rack of claim 1 wherein said attachment means includes a blade having a marginal edge portion which is sufficiently thin in cross-section to be received between the gasket and glass of a window to thereby enable the marginal edge of the blade to be forced between the gasket and glass and thereby hold the rack in mounted relationship respective to the window;

wherein said main body has a longitudinally extending slot formed thereon, said cradle means has a tongue which is slidably received within said slot and thereby enables the cradle means to be slidably positioned along the length of said main body.

5. A gun rack for mounting guns in supported relationship therewithin; said rack includes a main body having a gun receiving cradle means, attachment means formed at each opposed end of said main body by which the rack can be affixed to a support surface;

said main body has a hollow interior at one end thereof, one said attachment means has an extension which is slidably received within the hollow interior of the main body, thereby enabling the spaced opposed attachment means to be moved towards and away from one another, and thereby adjust the distance therebetween;

means by which said cradle means can be adjustably positioned longitudinally along the main body and said extension;

said main body is an elongated square tubular member having opposed sidewalls extended beyond a common sidewall and turned inwardly towards one another to form an outwardly opening slot;

a tongue affixed to said cradle means and made into a configuration to be slidably received within said slot, said cradle means being of a horseshoe configuration which upwardly opens;

a latch means extending through said tongue and through said common sidewall by which said cradle means is adjustably fixed respective to said main body.

6. A gun rack for mounting guns in supported relationship therewithin; said rack includes a main body having a gun receiving cradle means, attachment means formed at each opposed end of said main body by which the rack can be affixed to a support surface;

said main body has a hollow interior at one end thereof, one said attachment means has an extension which is slidably received within the hollow interior of the main body, thereby enabling the spaced opposed attachment means to be moved towards and away from one another, and thereby adjust the distance therebetween;

means by which said cradle means can be adjustably positioned longitudinally along the main body and said extension;

said attachment means includes a blade having a marginal edge portion which is sufficiently thin in cross-section to be received between the gasket and glass of a window whereby the marginal edge of the blade can be forced between the gasket and glass to hold the rack in mounted relationship therewith;

wherein said extension is provided with an outer surface having teeth formed thereon, said cradle means has means opening gun receiving cradle and further which engages the teeth with a ratchet action and thereby adjustably secures the extension to the main body.

7. A gun rack for mounting guns in supported relationship therewithin; said rack includes a main body having a gun receiving cradle means, attachment means formed at each opposed end of said main body by which the rack can be affixed to a support surface;

said main body has a hollow interior at one end thereof, one said attachment means has an extension which is slidably received within the hollow interior of the main body, thereby enabling the spaced opposed attachment means to be moved towards and away from one another, and thereby adjust the distance therebetween;

means by which said cradle means can be adjustably positioned longitudinally along the main body and said extension;

said extension is provided with an outer surface having teeth formed thereon, said cradle means has means at one end thereof for engaging said teeth with a ratchet action and thereby adjustably secures the extension to the main body;

wherein said body has means forming a longitudinally extending slot thereon, said cradle has a tongue made complementary respective to the slot which is slidably received within said slot and thereby enables the candle to be slidably positioned along the length of said main body.

8. A gun mount comprising spaced gun racks, each rack includes an elongated hollow main body having an upwardly opening cradle and further having attachment means at each opposed end thereof; an elongated slot formed along said main body;

one said attachment means includes an extension which is slidably received in a telescoping manner within said main body; means for adjustably affixing said extension respective to said main body;

said extension has one outer wall surface which is provided with teeth, said cradle has means which engages the teeth of the outer wall surface with a ratchet action and thereby adjustably secures the extension to the main body;

said cradle includes a slide member which is received within said elongated slot; and fastener means by which said cradle is affixed to said main body.

9. The gun mount of claim 8 wherein said attachment means includes a blade having a marginal edge portion which is sufficiently thin in cross-section to be received between the gasket and glass associated with a window, whereby the marginal edge of the blade can be forced between the gasket and glass to hold the rack in mounted relationship therewith.

10. The gun mount of claim 8 wherein said elongated slot is a longitudinally extending slot formed on one outer wall surface of said main body, said cradle has a tongue which is slidably received within said slot and thereby enables the cradle to be slidably positioned along the length of said main body.

11. The gun mount of claim 8 wherein said attachment means includes a blade having a marginal edge portion which is sufficiently thin in cross-section to be received between the gasket and glass of a window to thereby enable the marginal edge of the blade to be forced between the gasket and glass and thereby hold the rack in mounted relationship respective to the window.

12. A gun rack of the type wherein two said racks can be positioned in aligned relationship on a wall surface to thereby provide a gun mount for supporting guns therein; said rack includes an elongated, non-circular, hollow main body having an upwardly opening gun receiving cradle and further having attachment means formed at each opposed end thereof; said upwardly opening gun receiving cradle being adjustably affixed to said main body; means forming an elongated slot longitudinally along one side of said main body;

the attachment means located at one opposed end of said main body includes an extension which is telescopingly received respective to said main body; means for selectively affixing said extension respective to said main body to thereby adjust the distance between said attachment means; the attachment means at the other opposed end of said main body is fixed to said main body;

said extension has one outer wall surface which is provided with teeth, means formed on said cradle which engages the teeth of the outer wall surface and thereby adjustably secures the extension to the main body;

said cradle includes means forming a slide member which is received within said elongated slot; fastener means by which said cradle is affixed along the longitudinal length of said main body;

so that the distance between said attachment means can be adjusted by telescopingly moving said extension; and, a plurality of cradles can be adjustably positioned along the length of said main body.

13. The gun rack of claim 12 wherein said slide member is a tongue which is slidably received within said slot and thereby enables the cradle to be slidably positioned along the length of said main body.

14. The gun rack of claim 12 wherein said main body is an elongated square tubular member having opposed sidewalls extended beyond a common sidewall and turned inwardly towards one another to form said slot which is an outwardly opening slot;

a tongue affixed to said cradle and made into a configuration to be slidably received within said slot, said cradle being of a horseshoe configuration which upwardly opens;

a latch means extending through said tongue and through said common sidewall by which said cradle is adjustably fixed respective to said main body.

15. The gun rack of claim 12 wherein said attachment means includes a blade having a marginal edge portion which is sufficiently thin in cross-section to be received between the gasket and glass of a window whereby the marginal edge of the blade can be forced between the gasket and glass to hold the rack in mounted relationship therewith.

* * * * *